US008182337B2

(12) United States Patent
Abrink et al.

(10) Patent No.: US 8,182,337 B2
(45) Date of Patent: May 22, 2012

(54) JACKPOT SERVER, A METHOD OF PROCESSING A JACKPOT WIN AND A GAMING SYSTEM

(75) Inventors: Ulf Abrink, Balsta (SE); Sven Hakan Andersson, Sundbyberg (SE)

(73) Assignee: ACEI AB (SE)

( * ) Notice: Subject to any disclaimer, the term of this patent is extended or adjusted under 35 U.S.C. 154(b) by 770 days.

(21) Appl. No.: 12/178,405

(22) Filed: Jul. 23, 2008

(65) Prior Publication Data

US 2009/0156301 A1 Jun. 18, 2009

(30) Foreign Application Priority Data

Jul. 24, 2007 (AU) ..... 2007903982

(51) Int. Cl.
*A63F 9/24* (2006.01)

(52) U.S. Cl. ..... 463/26; 463/25; 463/42

(58) Field of Classification Search ..... 463/16, 463/25–28, 42, 43, 47
See application file for complete search history.

(56) References Cited

U.S. PATENT DOCUMENTS

| | | | | |
|---|---|---|---|---|
| 2002/0047044 | A1 | 4/2002 | Orus | |
| 2002/0094859 | A1 | 7/2002 | Hirsch | |
| 2005/0137010 | A1* | 6/2005 | Enzminger et al. | 463/25 |
| 2005/0239542 | A1* | 10/2005 | Olsen | 463/27 |
| 2006/0052162 | A1 | 3/2006 | Soukup | |
| 2006/0079320 | A1* | 4/2006 | Erickson | 463/25 |
| 2006/0100008 | A1 | 5/2006 | Wright | |
| 2006/0183529 | A1 | 8/2006 | Acres | |
| 2006/0211465 | A1* | 9/2006 | Moshal | 463/16 |
| 2006/0287077 | A1 | 12/2006 | Grav | |
| 2007/0032301 | A1 | 2/2007 | Acres | |

FOREIGN PATENT DOCUMENTS

| | | |
|---|---|---|
| BE | 1014377 | 9/2003 |
| CA | 2525527 | 12/2004 |
| CA | 2559412 | 3/2007 |
| JP | 2006180891 | 7/2006 |
| KR | 20030041374 | 5/2003 |
| LV | 13130 | 4/2004 |
| MX | PA05004612 | 3/2006 |
| WO | 03067534 | 8/2003 |
| WO | 2004097756 | 11/2004 |
| WO | 2006081022 | 8/2006 |
| WO | 2007049115 | 5/2007 |

* cited by examiner

*Primary Examiner* — David L Lewis
*Assistant Examiner* — Robert Mosser
(74) *Attorney, Agent, or Firm* — McAndrews, Held & Malloy, Ltd.

(57) ABSTRACT

A method of processing a jackpot win in a gaming network comprising: providing a jackpot server: receiving jackpot claim data at the jackpot server; locking a jackpot record corresponding to the jackpot claim data; aggregating any outstanding jackpot contributions for the jackpot record from contributing parts of the gaming network to form a prize; and communicating prize data corresponding to the prize to a network destination identified by the jackpot claim data.

14 Claims, 4 Drawing Sheets

JACKPOT SERVER, A METHOD OF PROCESSING A JACKPOT WIN AND A GAMING SYSTEM

RELATED APPLICATIONS

This application claims priority to Australian Provisional Patent Application No. 2007903982, having a filing date of Jul. 24, 2007, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

1. Technical Field

The present invention relates generally to handling jackpots in a gaming network.

2. Background

Gaming systems have been proposed that employ a client/server architecture. Such architectures can support very large numbers of gaming clients and accordingly present challenges for the management of prizes that can be awarded to one of a plurality of gaming machines such as a jackpot.

BRIEF SUMMARY OF THE INVENTION

In a first aspect, there is provided a method of processing a jackpot win in a gaming network, the method comprising:

providing a jackpot server:

receiving jackpot claim data at the jackpot server;

locking a jackpot record corresponding to the jackpot claim data;

aggregating any outstanding jackpot contributions for the jackpot record from contributing parts of the gaming network to form a prize; and communicating prize data corresponding to the prize to a network destination identified by the jackpot claim data.

In an embodiment the method comprises opening a new jackpot record to which new jackpot contributions may be made while outstanding jackpot contributions are aggregated.

In an embodiment opening a new jackpot record comprises generating a new jackpot record.

In an embodiment a new jackpot identifier is allocated to the new jackpot record and the method comprises communicating the new jackpot identifier to each participating gaming server.

In an embodiment the method comprises maintaining a record at the jackpot server for each participating gaming server.

In a second aspect, the invention provides a jackpot server for a gaming network, the jackpot server arranged to:

receive jackpot claim data;

lock a jackpot record corresponding to the jackpot claim data;

aggregate any outstanding jackpot contributions for the jackpot record from contributing parts of the gaming network to form a prize; and communicate prize data corresponding to the prize to a network destination identified by the jackpot claim data.

In an embodiment, the jackpot server comprises a jackpot database comprising the jackpot record.

In an embodiment, the jackpot server is arranged to open a new jackpot record in the jackpot database to which new jackpot contributions may be made while outstanding jackpot contributions are aggregated.

In an embodiment, the jackpot database comprises a game server contribution record for each of a plurality of participating game servers for each jackpot record, whereby the jackpot server can track game server contributions to each jackpot by each game server.

In a third aspect the invention provides a gaming network comprising:

a jackpot server;

a plurality of participating gaming servers each of which is connected to one or more participating gaming clients, the participating gaming clients and gaming servers implementing game instances that contribute to a jackpot, the jackpot server arranged to:

receive jackpot claim data from one of the participating gaming servers;

lock a jackpot record corresponding to the jackpot claim data;

aggregate any outstanding jackpot contributions for the jackpot record from contributing gaming servers to form a prize; and communicate prize data corresponding to the gaming server identified by the jackpot claim data.

In an embodiment, the jackpot server comprises a jackpot database comprising the jackpot record.

In an embodiment, the jackpot server is arranged to open a new jackpot record in the jackpot database to which new jackpot contributions may be made while outstanding jackpot contributions are aggregated.

In an embodiment, the jackpot database comprises a game server contribution record for each of a plurality of participating game servers for each jackpot record, whereby the jackpot server can track game server contributions to each jackpot by each game server.

In an embodiment the gaming clients are connected to the gaming servers by application servers.

BRIEF DESCRIPTION OF SEVERAL VIEWS OF THE DRAWINGS

The invention is further explained by means of the following non-limiting examples and in conjunction with the accompanying drawings, in which.

DETAILED DESCRIPTION OF THE INVENTION

In the embodiment the described method steps and functions are realized by computer system components, computer software code portions, or combinations thereof. It is within the knowledge of the skilled person to select appropriate components for the realization of the invention.

Figure 1:
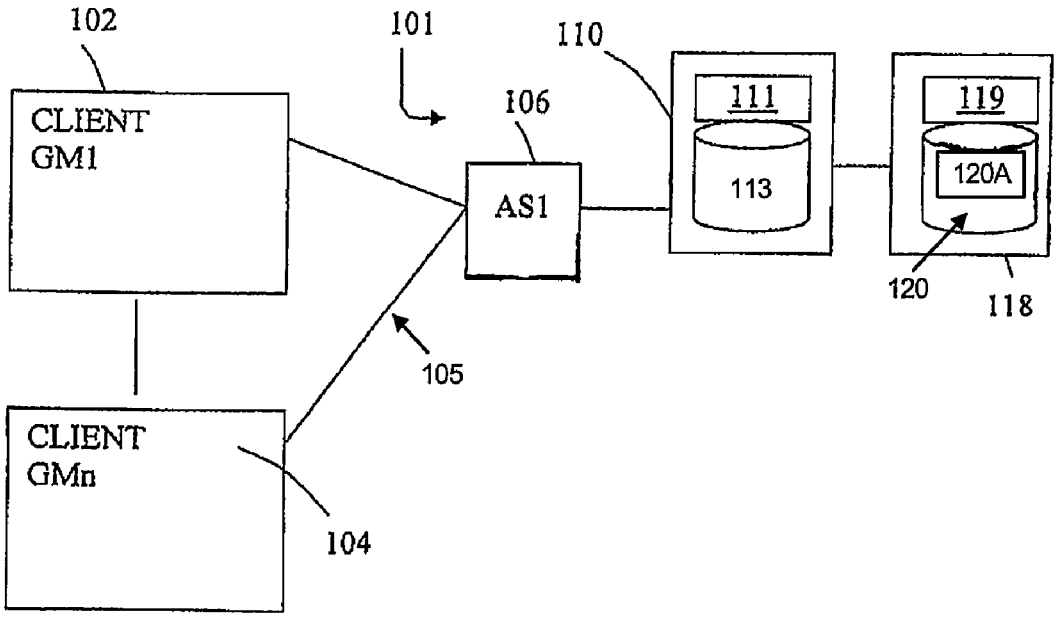
FIG. 1 shows schematically an embodiment of a client-server based gaming system with a plurality of gaming machines in accordance with an embodiment of the invention.

FIG. 1 shows schematically an exemplifying embodiment of a client/server based gaming system 101. A plurality of gaming machines (also known as gaming clients) operable by a player to play a game, here illustrated with a first client gaming machine GM1 102 and a second gaming machine GMn 104, where n is an arbitrary integer, are communicatively coupled to a game application server AS 106 via a communications network 105. The game application server 106 is in turn communicatively coupled to a game server database GSDB 110 which has a database application logic layer 111 and a database storage structure 113. The game server database 110 is further communicatively coupled to a back office database 118, similarly having a database application logic layer 119 and a back office database storage structure 120. The data structure 120 of the back office database 118 includes a jackpot database 120A. Thus, the back office database provides a jackpot server.

Figure 3:
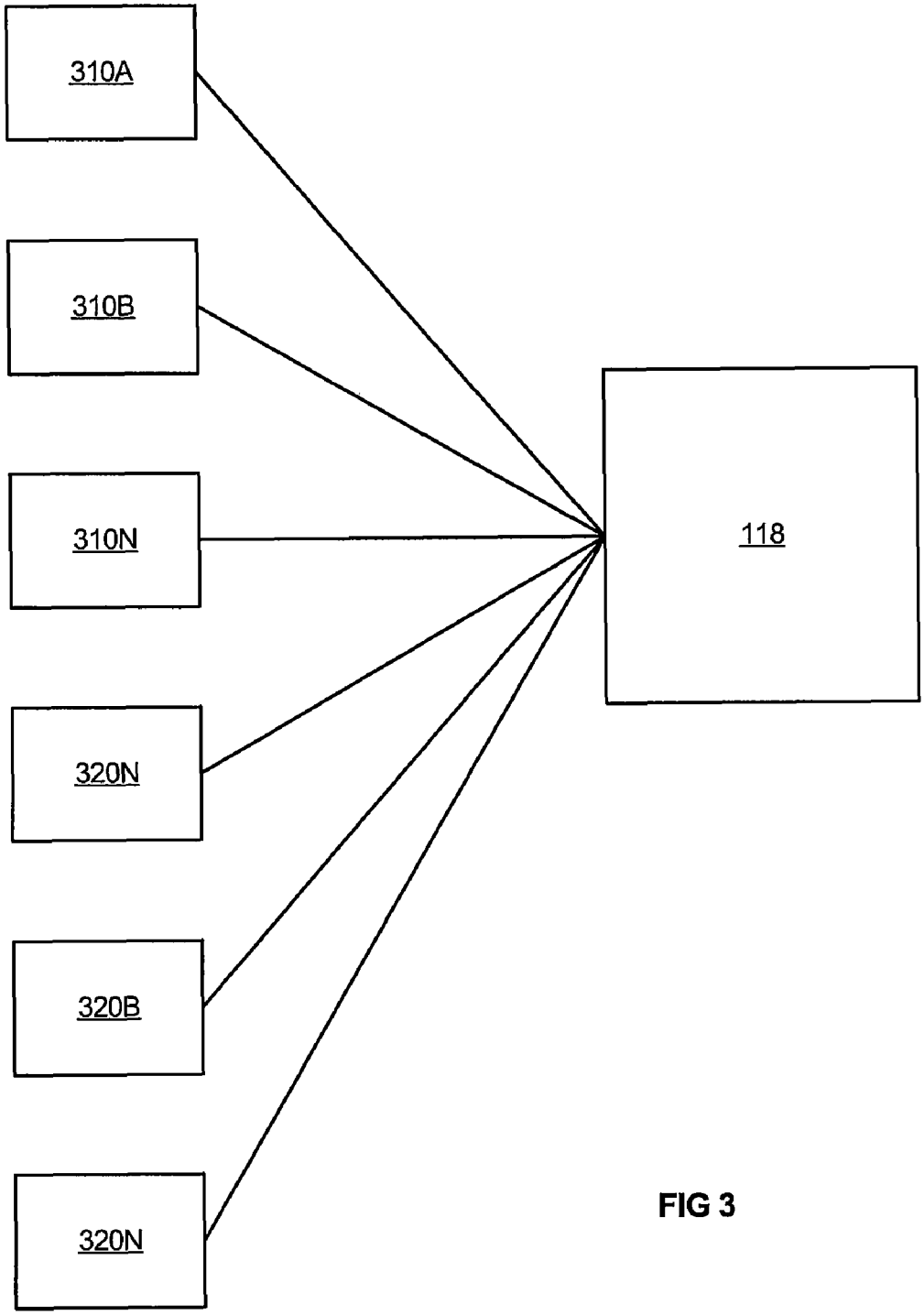
FIG. 3 is a schematic diagram of a gaming network.
Figure 4:
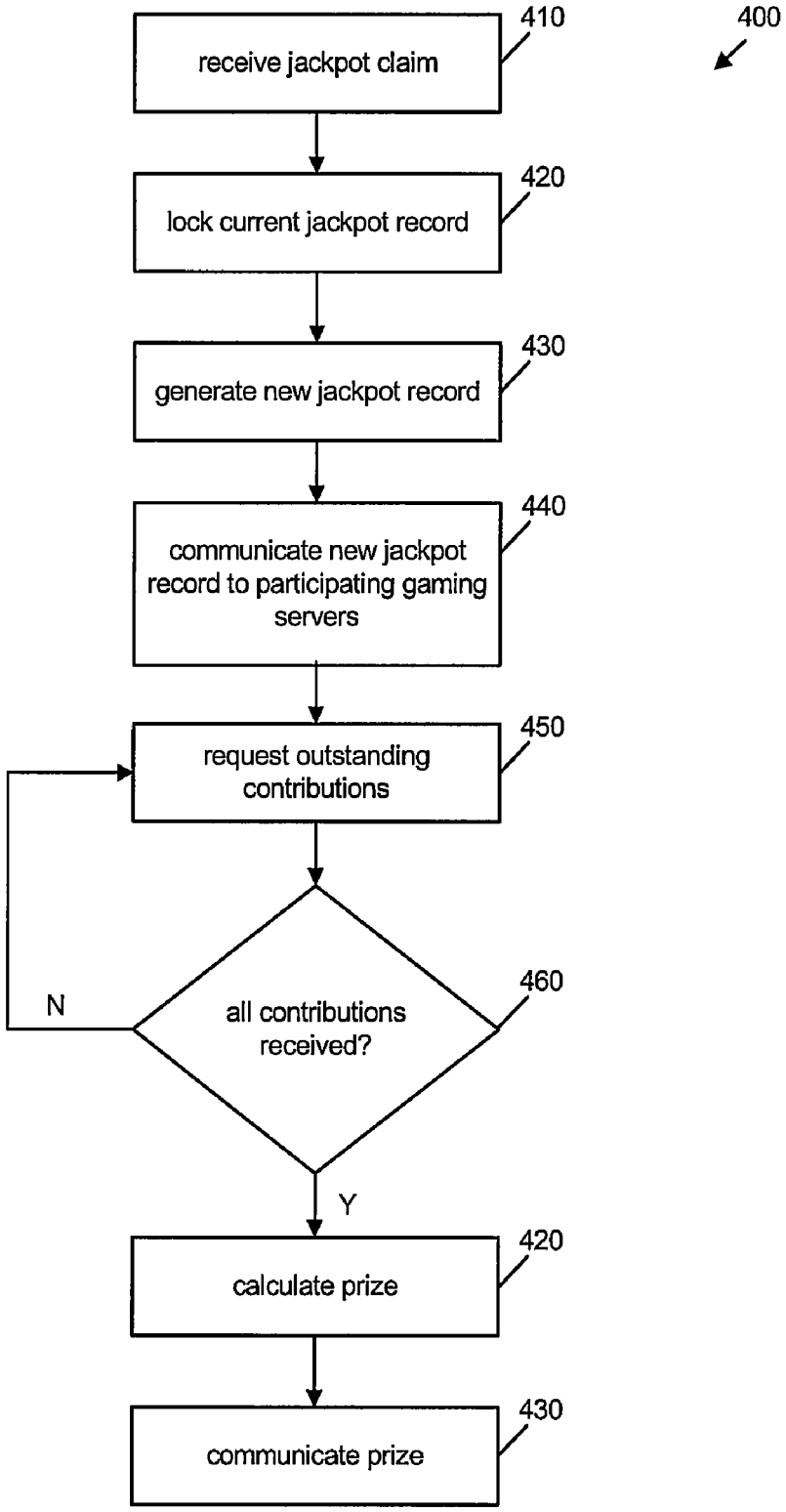
FIG. 4 is a flowchart of an embodiment.

Persons skilled in the art will appreciate that game server 110 will typically be one of a plurality of game servers 310, 320 in a gaming network as illustrated in FIG. 3. Such a gaming network may have a first plurality of gaming servers 310 from a first jurisdiction and a second plurality of gaming servers 320 from second jurisdiction.

It will be appreciated that not all of the game servers 310, 320 may contribute to the same jackpot. Further jackpots can be defined at a number of levels, for example a global jackpot, a jackpot for servers from the first jurisdiction, a jackpot for a single server 320B of the second jurisdiction etc. Herein game servers 310, 320 that contribute to a jackpot are said to be participating servers. Similarly not all gaming clients may contribute, for example, only gaming clients playing certain games may contribute. Gaming clients that contribute, are similarly referred to as participating gaming clients.

"Communicatively coupled" in this text means that there is a communication link over which information signals can be communicated between two coupled units, for example in the form data packets or the like. The communication link can for example be continuously activated in an on-line state or be activated on request when a message, e.g. in the shape of a request or a response, is communicated.

The gaming system according to the present embodiment of is based on a client/server architecture where the game software is divided into a client game module and a server game module with access to a central database. In order to run a game the client game module must be associated with and use functions available at a server game module. When a game is played via a client gaming machine, a game session is established and game session data is generated in the course of the game. Each game session has a specific identity and is assigned a game session identify code. The game session data is stored in the game server database 110 associated with the game session identity code.

Figure 2:
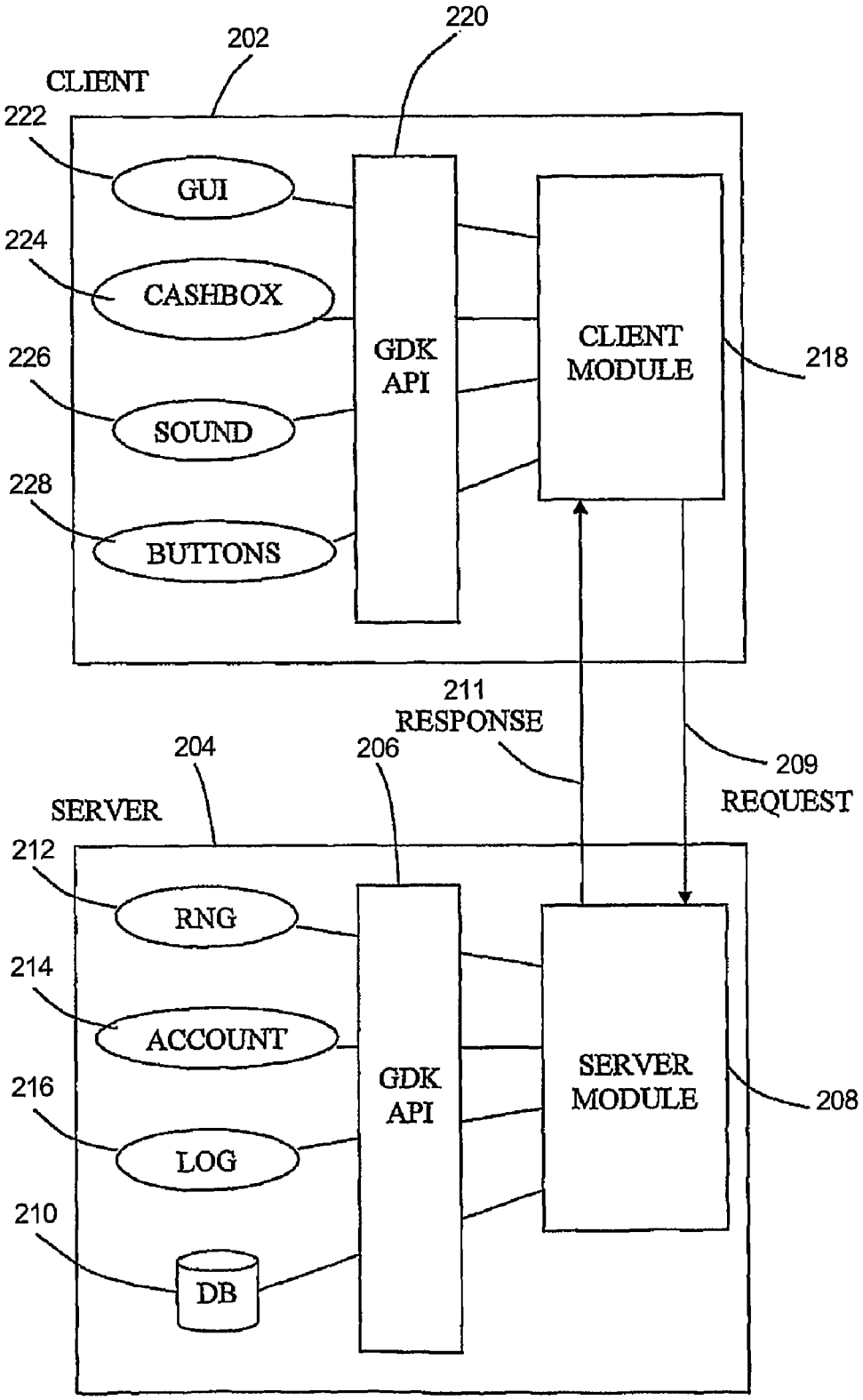
FIG. 2 shows a block diagram of further components of a gaming system.

FIG. 2 shows schematically a client and server based computerised gaming system with a client gaming machine terminal 202 and a gaming server 204 that are communicatively coupled. The gaming machine 202 and the gaming server 204 are provided with data processors, memory, data communications interfaces, control programs, user input/output interfaces etc. in a per se well known manner. Different functions and features that are specific for the embodiment are preferably realised by software computer program code executed by data processors in the server and in the client respectively, or by employing specifically designed electronic components, or by means of combinations of software and electronic components. In the example of FIG. 2 there is only a single client gaming machine 202 but of course a number of client gaming machines can be and are normally connected to a server 204. In this context a server 204 generally means hardware and software units in a central system that provide server functions, database functions and other centralized functions to connectable client gaming machines.

The server 204 is provided with a game application program interface, in short called server game API 206, enabling communication between a server module of a specific game application program 208 and general server gaming functions 210,212,214,216 installed on the server. The general server gaming functions are provided to be available for any specific game application program independently of the specific game content. These general server gaming functions are typically functions such as a database 210, a random number generator 212, an account service function 214, a log service function 216, or other functions that can be beneficially shared and used by different specific game application programs.

The client gaming machine 202 is also provided with a game application program interface, in short called client game API 220, enabling communication between a client game module 218 of the specific game application program and general client gaming functions 222,224,226,228 installed on the client gaming machine 202 and used by different client game modules. The general client gaming functions are designed for assisting in implementing and executing a specific game on the client gaming machine 202 and are available for the client game module 218. These general client gaming functions are in different embodiments a selection of a graphical user interface (GUI) 222, a cashbox function 224, a sound function 226, user input interface function, for example buttons, 228, data storage 229, a printer 203, a bar code reader 233 and other functions that are related to the performance of a game. The client game module 218 is communicatively coupled to the corresponding server game module 208 for communicating requests 209 and responses 211 in order to utilize the general gaming functions provided in the server. For each game a message protocol for communication between the client module and the server module is generated, the protocol is for example based on XML and is shared by the client and the server.

A specific game application program thus has a server game module 208 and a client game module 218 that communicate either directly or via an application program interface on the client side and the server side respectively as shown in FIG. 2. The client game module 218 uses a selection of general client gaming functions that are available in the client gaming machine, whereas the server module 208 uses a selection of general server gaming functions 210,212,214, 216 that are commonly used by different game applications and that are provided and available centrally in the server 204. Further details of a server gaming architecture can be found in WO 2006/052213 and PCT/SE2006/000559, the disclosures of which are incorporated herein by reference.

Establishment of the gaming session involves the gaming server loading the relevant server module, and providing (if necessary) the relevant client module to the client gaming machine.

Exemplary Database Configuration

As indicated above the gaming network may run a series of concurrent jackpot instances. Accordingly, the jackpot database 120A is arranged such that:

- A jackpot can be defined to be global, i.e. to incorporate the entire game network tree.
- Jackpots can be assigned to a logical node, thus incorporating all nodes below.
- A jackpot (J) is tied to a single game variant.
- A jackpot can be defined with a maximum number of levels, for example five (5) levels, although less may be used. The different levels of a jackpot are in referred to as a Jackpot Levels (JL). For example this jackpots may be Grand Jackpot, Super Jackpot, and (normal) Jackpot.

JL 1 is the largest jackpot, e.g. Grand Jackpot.

The jackpot database assumes that the game session does the calculations on how much of each bet should be added to the different jackpot level instances.

Contributions and jackpot game events are handled by each game session.

The jackpots are synchronized between game server databases (GSDBs) 110 and the back office database (BODB) 118 using sequence numbers. The BODB pushes a sequence number to the GSDBs and collects the accumulated contribution amounts on the previous sequence number(s). The GSDB then starts over using the new sequence number.

In case of a jackpot win, the GSDB reports immediately to the BODB that a win has occurred, and on which level—e.g. JL2 (jackpot level 2). The BODB then sends a sequence update to other GSDBs, thus receiving their accumulated bets for the winning sequence. When all GSDB have reported, the accumulated win amount is returned to the GSDB. The Jackpot continues with further contributions being made with the new sequence number.

As indicated above, the back office database (e.g. BODB) needs to store information that is used to define the jackpot, to log 'current' status and historic payouts, and (eventually in a future release) to keep track of the sponsor monetary status. The jackpot database stores the data in a number of tables:

Jackpot_Definition Table

This table is used to store all the basic information on a jackpot. There is one record for each jackpot.

Jackpot_Def_Level Table

This table is used to store all the basic information on a jackpot level. There is one record for each jackpot level.

Jackpot_Status Table

This table is used to store different status ids used in the Jackpot_Instance_GS_Sync and Jackpot_Instance_Win tables.

Jackpot_Instance Table

This table is used to log current information on a jackpot instance. BODB uses it to store up-to-date values each jackpot, as well as keeping track of the sequence numbers.

Jackpot_Instance_Win Table

This table is used to log jackpot wins.

Jackpot_Instance_GS_Sync Table

This table is used to log the current BODB information from a GSDB on a jackpot. At win time the current sequence record is copied to the Jackpot_Instance_GS_Win table.

GS_Jackpot_Instance_Client Table

This table is used to hold the current jackpot instance information. There is one record for each active client and jackpot instance Jn. The client creates a new record whenever needed, i.e. when the sequence number in the GS_Jackpot_Sequence table was updated.

Exemplary Game Server Database Configuration

Each of the GSDBs has a set of requirements:

Each GSDB needs current jackpot information, i.e. the current sequence number, to allow quick lookup of the jackpot.

Each GSDB holds current jackpot contribution information for each game session.

The current jackpot information for each game session must be synchronized frequently to the (BODB) Jackpot synchronization table.

If a new GSDB 110 is added, jackpot information should be added before any playing starts.

Each GSDB is polled by the back office database 118 for the latest jackpot amounts at a regular basis, i.e. every 10 to 15 seconds.

The process for updating the back office with contribution amounts must handle any GSDB being offline and in an unknown state in regard to the jackpot state, e.g. are there contributions outstanding.

To store this data, the GSDB employs the following table.

GS_Jackpot_Sequence Table

This table is used to find the current jackpot instance. There is one record for each active jackpot J. This is read before each contribution is stored to use the latest sequence. The sequence is updated when the GSDB syncs money to the common jackpot database (i.e. BODB) and, from BODB, when a Jackpot (level) is won.

Jackpot_Instance_GS_Win Table

This table is used to log the win record for each GSDB on a jackpot. At win time the current sequence record is copied from the Jackpot_Instance_GS_Sync table.

Exemplary Setup

During setup, the jackpot definition is created in BODB 118. The BODB starts a new jackpot set. This is done at installation time of the game.

The following tables provided in the BODB 118 and populated for a jackpot at setup:

Jackpot_Defintion: One record for each jackpot.

Jackpot_Def_Level: One record for each jackpot and jackpot level, i.e. if a jackpot has three levels there should be three records for that jackpot.

Jackpot_Instance: One record for each jackpot. (In a future release there may exist multiple records for each jackpot, e.g. for different venues.)

Jackpot_Instance_GS_Sync: One record for each GSDB and jackpot (instance).

The following table is provided in the GSDB 110 and should be populated for a jackpot at setup:

GS_Jackpot_Sequence: One record for each jackpot.

Each game server database is initialized with all available jackpots, i.e. records created in the jackpot instance table.

1. When an application server logs in to a GSDB 110, the GSDB is checked for the presence of all available jackpots by checking the BODB.

2. Any missing jackpot is added to the GSDB and to the back office jackpot instance GSDB table (there should be a table in the back office with a record for each GSDB and jackpot instance).

3. Jackpots are defined and identified by their jackpot instance number.

4. For each jackpot there is a Sequence number defining the current summarization set, i.e. the synchronization with the BODB.

5. The Sequence number is updated each time jackpot amounts are reported to the BODB, i.e. for the normal reporting frequency and at each jackpot win.

6. The Sequence number is used to store jackpot information for each game round event that contributes to the jackpot at the GSDB.

Exemplary Management of Contributions

The back office database is updated with the latest jackpot amounts from each game server database at a regular basis. This process handles any GSDB being offline and in an unknown state in regard to the jackpot state, e.g. are there contributions outstanding.

1. The process is asynchronous between the actions on the BODB and on each GSDB for timing, performance and consistency reasons.

2. Actions by the BODB:

a. The jackpot instance table is updated to the next Sequence number.

b. The jackpot instance table on each active GSDB is updated with the new Sequence number from the BODB.

c. Check the current Sequence number against the last used for an update.

d. Update the BODB record amounts for each GSDB.

e. As this is an asynchronous process relative the actions by the BODB, there may be several sequence numbers involved in each update, possibly with a jackpot win in-between f. Whenever a jackpot instance amount is updated, there is a push by the GSDB to each application server to alert them that new values are available.

Exemplary Game Sessions

1. A number of players start game sessions in the game that holds the jackpot.

2. Game round event information comes to the GSDB with information about the jackpot contribution amount and the jackpot instance id.

3. The jackpot instance information for the game session is updated using the current Sequence number, or inserted if this is a new Sequence number.

4. The process repeats it self indefinitely, until the jackpot is closed.

Exemplary Processing of a Jackpot Win

1. The game module of a gaming client may at any time ask for a jackpot win id eventually be used to register a win.

2. Jackpot win a. The game session announces a jackpot win via the GSDB inputting the jackpot win id and the percentage won for each jackpot level.

b. The BODB immediately locks the jackpot instance record preventing any other win to be registered concurrently (those will wait on the lock).

c. The Sequence number for the jackpot instance is updated.

d. A new record is created in the jackpot instance GSDB synchronization table for any contributions to the next jackpot win, initiated with any amounts not won.

e. A win record is created in the jackpot instance win log table containing client, player, and game session ids.

f. The BODB initiates a job process to get update from each participating GSDB of any outstanding contributions.

i. The GSDB update is asynchronous and autonomous relative the initiating process.

ii. When the GSDB is done with the jackpot win the record in the jackpot instance GSDB synchronization table, the record is moved to the jackpot instance GSDB win log table.

g. The jackpot win is committed, allowing any waiting win to proceed.

3. The client requests jackpot win status and amounts.

a. The BODB is checked for completeness of the GSDB updates for this jackpot.

b. If all GSDBs are done then a Done flag and the total amount is returned and the amount and status is logged in the jackpot instance win log table.

c. If some GSDBs are not done then a Not done is returned.

d. If Not done is returned the client will wait for some time and then request the information again.

e. At some point the client will decide to print a reconnect voucher instead of waiting for a Done flag.

Exemplary Application Server

1. The application server receives a push message from the database alerting it that updated jackpot values are available.

2. The application server requests current jackpot balances for all active jackpots from the database and caches them locally.

3. When the application server receives a request for jackpot balances from a client (IVT or ICT), it uses the cached jackpot data.

Exemplary Reconnect

Occasionally a game session may be ended with an outstanding jackpot claim. A reconnect voucher will be issued which will allow the player to claim the jackpot.

1. At the reconnect entitlement activation a. The jackpot instance win table is checked for a win for the actual game session.

b. If found, the jackpot win id is stored in the reconnect data.

2. At reconnect time a. If the jackpot win id is set in the reconnect data then the last event replayed should return a jackpot won flag.

b. The client then continues as for a normal reconnect with the jackpot value as it was at the time of the win.

The invention has been described by way of exemplifying embodiments, but naturally there are various manners of realising the invention within the scope of the claims. In particular, it will be apparent that features of certain of the above embodiments and examples can be employed to form further embodiments.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of processing a jackpot win in a gaming network, the method comprising:

providing a jackpot server;

receiving jackpot claim data at the jackpot server, said jackpot claim data having a corresponding jackpot record;

locking said jackpot record corresponding to the jackpot claim data;

aggregating outstanding jackpot contributions for the locked jackpot record from the remaining contributing parts of the gaming network;

forming a prize from said aggregated outstanding jackpot contributions after the jackpot win has occurred; and communicating prize data corresponding to the prize to a network destination identified by the jackpot claim data.

2. A method as claimed in claim 1, and further comprising opening a new jackpot record to which new jackpot contributions may be made while outstanding jackpot contributions are aggregated.

3. A method as claimed in claim 2, wherein opening a new jackpot record comprises generating a new jackpot record.

4. A method as claimed in claim 3, wherein a new jackpot identifier is allocated to the new jackpot record, and the method further comprising communicating the new jackpot identifier to each participating gaming server.

5. A method as claimed in claim 1, and further comprising maintaining a record at the jackpot server for each of a plurality of participating gaming servers of the gaming network.

6. A jackpot server for a gaming network, the jackpot server arranged to:

receive jackpot claim data, said jackpot claim data having a corresponding jackpot record;

lock said jackpot record corresponding to the jackpot claim data;

aggregate outstanding jackpot contributions for the locked jackpot record from the remaining contributing parts of the gaming network;

form a prize from said aggregated outstanding jackpot contributions after the jackpot win has occurred; and communicate prize data corresponding to the prize to a network destination identified by the jackpot claim data.

7. A jackpot server as claimed in claim 6, and further comprising a jackpot database comprising the jackpot record.

8. A jackpot server as claimed in claim 7, and further arranged to open a new jackpot record in the jackpot database to which new jackpot contributions may be made while outstanding jackpot contributions are aggregated.

9. A jackpot server as claimed in claim 7, and wherein the jackpot database comprises a game server contribution record for each of a plurality of participating game servers for each jackpot record, and wherein the jackpot server tracks game server contributions to each jackpot by each game server.

10. A gaming network comprising:

a jackpot server; and a plurality of participating gaming servers each of which is connected to one or more participating gaming clients, the participating gaming clients and gaming servers implementing game instances that contribute to a jackpot, and wherein the jackpot server arranged to:

receive jackpot claim data from one of the participating gaming servers, said jackpot claim data having a corresponding jackpot record;

lock a jackpot record corresponding to the jackpot claim data;

aggregate outstanding jackpot contributions for the locked jackpot record from the remaining contributing parts of the gaming network;

form a prize from said aggregated outstanding jackpot contributions after the jackpot win has occurred; and communicate prize data corresponding to the gaming server identified by the jackpot claim data.

11. A gaming network as claimed in claim 10, and wherein the jackpot server comprises a jackpot database comprising the jackpot record.

12. A gaming network as claimed in claim 10, and wherein the jackpot server is further arranged to open a new jackpot record in the jackpot database to which new jackpot contributions may be made while outstanding jackpot contributions are aggregated.

13. A gaming network as claimed in claim 11, and wherein the jackpot database comprises a game server contribution record for each of a plurality of participating game servers for each jackpot record, and wherein the jackpot server can track game server contributions to each jackpot by each game server.

14. A gaming network as claimed in claim 10, and wherein the gaming clients are connected to the gaming servers by application servers.

* * * * *